US006078245A

United States Patent [19]

Fritz et al.

[11] Patent Number: 6,078,245

[45] Date of Patent: Jun. 20, 2000

[54] CONTAINMENT OF TIN DIFFUSION BAR

[75] Inventors: Sandra E. Fritz, Libertyville; Anthony Minervini, Orland Park; Thomas Restis, Des Plaines, all of Ill.

[73] Assignee: Littelfuse, Inc., Des Plaines, Ill.

[21] Appl. No.: 09/213,193

[22] Filed: Dec. 17, 1998

[51] Int. Cl.[7] ..... H01H 85/046; H01H 85/11; H01H 69/02

[52] U.S. Cl. ..... 337/297; 337/160; 337/296; 337/290

[58] Field of Search ..... 29/623; 337/166, 337/290, 295, 296, 416, 160, 297, 152, 227; 257/529

[56] References Cited

U.S. PATENT DOCUMENTS

| | | | |
|---|---|---|---|
| 2,808,487 | 10/1957 | Jacobs, Jr. | 337/160 |
| 3,810,062 | 5/1974 | Kozacka | 337/161 |
| 5,552,757 | 9/1996 | Blecha et al. | 337/297 |
| 5,668,522 | 9/1997 | Kondo et al. | 337/198 |
| 5,739,741 | 4/1998 | Hanazaki et al. | 337/290 |

FOREIGN PATENT DOCUMENTS

| | | | |
|---|---|---|---|
| 1114804 | 5/1968 | United Kingdom | 337/160 |

*Primary Examiner*—Leo P. Picard
*Assistant Examiner*—Anatoly Vortman
*Attorney, Agent, or Firm*—Wallenstein & Wagner, Ltd.

[57] ABSTRACT

A thin film surface-mountable fuse for protection against electrical overload. The fuse comprises a substrate, fusible link, a containment compound, and a pair of terminal pads. The fusible link is produced from a first conductive material and supported on the substrate. A diffusion bar of a second conductive material is deposited on a portion of the fusible link. The containment compound is also deposited over a portion of the fusible link. The containment compound inhibits migration of the diffusion bar along the fusible link during an electrical overload. The terminal pads are electrically connected to the fusible link and also supported by the substrate.

29 Claims, 1 Drawing Sheet

CONTAINMENT OF TIN DIFFUSION BAR

TECHNICAL FIELD

The present invention generally relates to a surface-mountable fuse for placement into and protection of the electrical circuit of a printed circuit board.

BACKGROUND OF THE INVENTION

The electrical circuits formed on printed circuit (PC) boards, like larger scale, conventional circuits, need protection against electrical overloads. This protection is typically provided by subminiature fuses that are physically secured to the PC board. Examples of such subminiature, surface-mounted fuses are disclosed in U.S. Pat. Nos. 5,166,656 and 5,552,757.

Various problems have been encountered in such subminiature surface-mount fuses. Specifically, predicting the location along the fusible link where the fuse will blow has been difficult. To solve this problem, manufacturers have added a diffusion bar to the fusible link. The diffusion bar is produced from a material which has a lower melting temperature than the material used to form the fusible link. This practice is described in the commonly assigned U.S. Pat. No. 5,552,757, which is incorporated herein by reference. As the fusible link reaches a normal operating temperature which coincides with the melting temperature of diffusion bar material, some percentage of the diffusion bar diffuses into the fusible link. This causes a eutectic reaction in the diffusion bar area of the fusible link thus lowering the melting temperature of that portion of the fusible link so that the fusible link selectively blows in that region.

Manufacturers have also encountered problems with the diffusion bar. For instance, as the diffusion bar reaches its melting temperature, rather than diffusing into the fusible link, it will liquify and roll along the fusible link, and the desirable eutectic reaction will be adversely affected. In other instances, while in the molten state, the diffusion bar can ballistically project itself from the fusible link at the operating temperature of the circuit. This decreases the amount of the material in the diffusion bar available for the eutectic reaction, and the probability of overheating is increased.

In many instances overheating may lead to charring of the substrate material. Additionally, the combination of the heated fusible link and the charred substrate heat the epoxy conformal coating of the fuse to its flash point, eventually igniting it. This is undesirable because it can destroy the circuit and cause other hazards.

The present invention was developed to solve these and other problems.

SUMMARY OF THE INVENTION

The present invention provides a thin film surface-mountable fuse for insertion into a circuit board. The fuse comprises a substrate or core, a fusible link, a pair of terminal pads, and a containment compound.

The substrate or core is preferably produced from a solid sheet of an FR-4 epoxy. Although FR-4 epoxy is a preferred material for the substrate or core, other suitable materials include any material that is compatible with the materials from which printed circuit boards are made. Thus, another suitable material for the substrate or core is polyimide. FR-4 epoxy and polyimide are among the class of materials having physical properties that are nearly identical with the standard substrate material used in the printed circuit board industry. As a result, the fuse of the invention and the printed circuit board to which the fuse is secured have extremely well-matched thermal and mechanical properties. The substrate or core of the fuse of the present invention also provides desired arc-tracking characteristics, and simultaneously exhibits sufficient mechanical flexibility to remain intact when exposed to the rapid release of energy associated with arcing.

The two terminal pads and the fusible link are produced from a first conductive material and bonded to the substrate as a single continuous film. The terminal pads are located on a bottom surface, side surfaces and a top surface of the substrate or core. The fusible link is formed on a top surface of the substrate or core and electrically connects the terminal pads. It will be appreciated that the width, length and shape of both the fusible link and the terminal pads may be varied depending on the desired application.

The terminal pads are made up of a plurality of layers, including a first layer of a copper or copper alloy, a second layer also of a copper or copper alloy, a third layer of a nickel or nickel alloy, and a fourth layer of a tin or tin alloy. The first or base copper layer of the terminal pads and the fusible link are simultaneously deposited by (1) electrochemical processes, such as plating; or (2) by physical vapor deposition (PVD). Such simultaneous deposition ensures a good conductive path between the fusible link and the terminal pads. This type of deposition also facilitates manufacture, and permits very precise control of the thickness of the fusible link.

The diffusion bar is deposited on a portion of the fusible link. The diffusion bar is comprised of a second conductive metal, such as tin, that is dissimilar to the first conductive material of the fusible link. This second conductive metal in the form of the diffusion bar is deposited onto the fusible link in a rectangular shape.

The containment compound is deposited over a portion of the fuse. The containment compound prevents migration of the diffusion bar along or off of the fusible link when an electrical overload condition develops. Preferably, the containment compound is deposited over the fusible link and, in particular, the diffusion bar. The containment compound will generally overlap onto a portion of the substrate, preferably less than 20 mils, more preferably between 5 and 10 mils, or any range or combination of ranges therein.

Other advantages and aspects of the present invention will become apparent upon reading the following description of the drawings and detailed description of the invention.

DETAILED DESCRIPTION OF THE INVENTION

Figure 1:
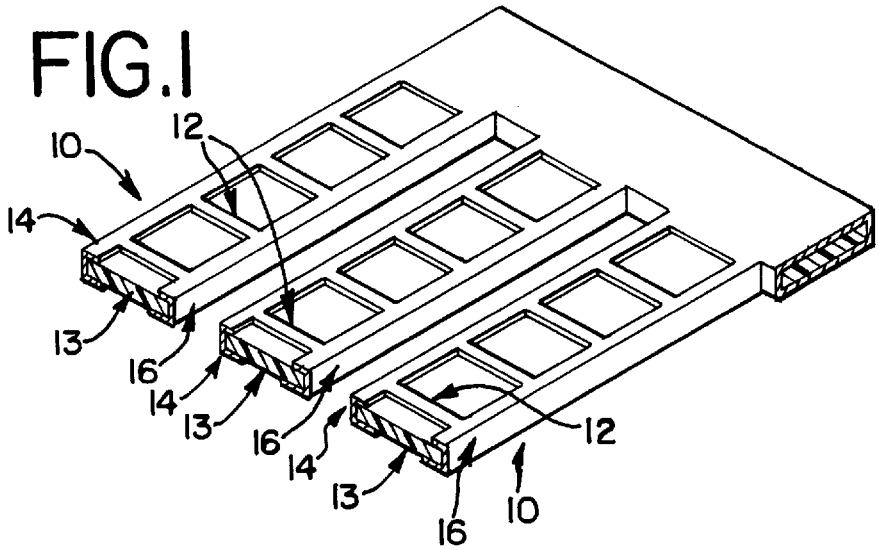
FIG. 1 is a top view of a strip of fuses of the present invention without the conformal layer.
Figure 2:
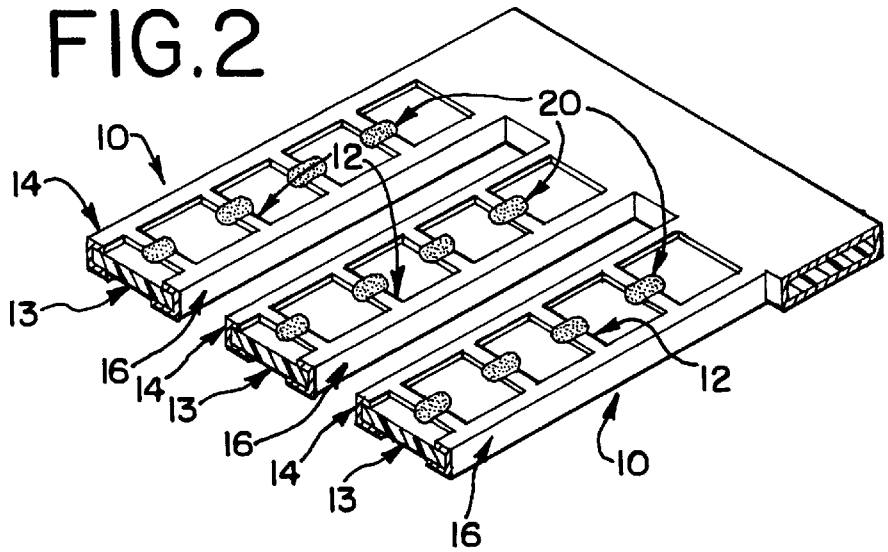
FIG. 2 is a top view of a strip of fuses of the present invention with the containment compound layer added.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 3:
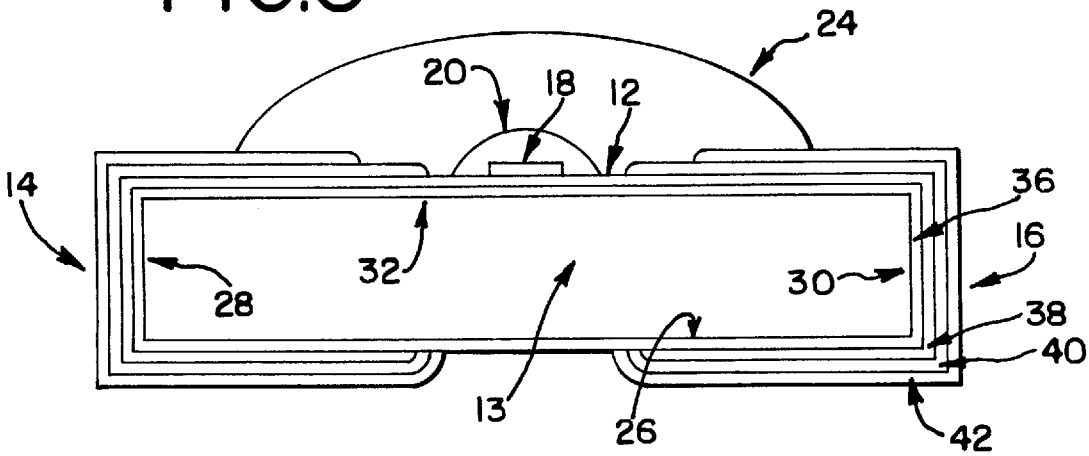
FIG. 3 is a cross sectional view of a single fuse of the present invention with the conformal layer added.

An embodiment of the present invention is shown in FIG. 1. The surface-mounted fuse 10 comprises a subminiature fuse used in a surface mount configuration on a printed circuit board or on a thick film hybrid circuit. The surface mountable fuse 10 comprises a fusible link 12, a supporting substrate or core 13, and terminal pads 14, 16 connecting the fuse to the printed circuit board. As shown in FIG. 3, a diffusion bar 18 is positioned on the fusible link 12. A containment compound 20 is added over a portion of the fusible link 12. Finally, a conformal layer 24 overlies the fusible link 12, the containment compound 20 and a substantial portion of the top portion of the fuse 10 so as to provide protection from impacts which may occur during automated assembly, and protection from oxidation during use.

The fusible link 12 is produced from a first conductive material. This material may be any conductive substance but is preferably chosen from a group consisting of copper, silver, gold, nickel, zinc, tin, titanium, aluminum, or alloys thereof. The two terminal pads 14, 16 and the fusible link 12 are bonded to the substrate as a single continuous film. The terminal pads 14, 16 are located on a bottom surface 26, side surfaces 28, 30 and a top surface 32 of the substrate or core 13. The fusible link 12 is formed on the top surface 32 of the substrate or core 13.

The fusible link 12 is in electrical communication with the terminal pads 14, 16. It will be appreciated that the width length and shape of both the fusible link 12 and the preferably wider, terminal pads 14, 16 may be altered depending on the desired application.

As will be seen, in the preferred embodiment, the terminal pads 14, 16 are made up of a plurality of layers, including a first layer 36 of a copper or copper alloy, a second layer 38 also of a copper or copper alloy, a third layer 40 of a nickel or nickel alloy, and a fourth layer of a tin or tin alloy. The first or base copper layer 36 of the terminal pads 14, 16 and the fusible link 12 are simultaneously deposited by (1) electrochemical processes, such as plating; or (2) by physical vapor deposition (PVD). Such simultaneous deposition ensures a good conductive path between the fusible link 12 and the terminal pads 14, 16. This type of deposition also facilitates manufacture, and permits very precise control of the thickness of the fusible link 12 and the terminal pads 14, 16.

After initial placement of the fusible link 12 and the first base copper layer 36 onto the substrate or core 13, the additional layers of conductive metals are deposited on the first layer 36 to produce and develop the terminal pads 14, 16. These additional layers can be defined and placed onto the previous layers by conventional photolithographic and deposition techniques, respectively.

The substrate or core 13 is preferably produced from a solid sheet of an FR-4 epoxy which has been plated with copper. This type of copper-plated FR-4 epoxy sheet 10 is available from Allied Signal Laminate Systems, Hoosick Falls, N.Y., as Part No. 0200BED130C1/CIGFN0200 C1/CIA2C. Although FR-4 epoxy is a preferred material for the substrate or core 13, other suitable materials include any material that is compatible with, i.e., of a chemically, physically and structurally similar nature to, the materials from which printed circuit boards are made. Thus, another suitable material for the substrate or core 13 is polyimide. FR-4 epoxy and polyimide are among the class of materials having physical properties that are nearly identical with the standard substrate material used in the printed circuit board industry. As a result, the fuse 10 of the invention and the printed circuit board to which that fuse 10 is secured have extremely well-matched thermal and mechanical properties. The substrate or core 13 of the fuse 10 of the present invention also provides desired arc-tracking characteristics, and simultaneously exhibits sufficient mechanical flexibility to remain intact when exposed to the rapid release of energy associated with arcing.

The substrate or core 13 is prepared for use in the fuse 10 by etching away the copper with a ferric chloride solution. The fuse 10, including the fusible link 12, the terminal pads 14, 16, and the diffusion bar 18, of the present invention is manufactured according to procedures known in the art, such as those described in U.S. Pat. No. 5,552,757, which is incorporated herein by reference.

The diffusion bar 18 is deposited on a portion of the fusible link 12. The diffusion bar 18 is comprised of a second conductive metal, i.e., tin, which is dissimilar to the copper metal of the fusible link 12. Preferably, the second conductive metal in the form of the diffusion bar 18 is deposited onto the fusible link 12 in a rectangular shape. The ratio of the thickness of the fusible link 12 to the thickness of the diffusion bar is preferably greater than 1 more preferably exceeding 2, and most preferably exceeding 2.5, or any range or combination of ranges therein.

The diffusion bar 18 on the fusible link 12 provides the link 12 with certain advantages. First, the diffusion bar 18 melts upon current overload conditions, creating a fusible link 12 that becomes a tin-copper alloy. This tin-copper eutectic reaction results in a fusible link 12 having a lower melting temperature than either the tin or copper alone. The lower melting temperature reduces the operating temperature of the fuse device 10 of the invention, and results in improved performance of the device.

Although tin is deposited on the copper fusible link 12 in this example, it will be understood by those skilled in the art that other conductive metals may be placed on the fusible link 12 to lower its melting temperature, and that the fusible link 12 itself may be made of conductive metals other than copper. In addition, the tin or other metal deposited on the fusible link 12 need not be of a rectangular shape, but can take on any number of additional configurations.

The containment compound 20 is deposited over a portion of the fuse 10. The containment compound 20 prevents migration of the diffusion bar 18 along or off of the fusible link 12 when an electrical overload condition develops. Preferably, the containment compound 20 is deposited over the fusible link 12 and, in particular, the diffusion bar 18. The containment compound 20 will generally overlap onto a portion of the substrate 13, preferably less than 20 mils, more preferably between 5 and 10 mils, or any range or combination of ranges therein.

The containment compound 20 is produced from a clay material. The preferred compound comprises an alumina-silica clay suspended in a solvent. Such a material is commercially available under the trade name Nicrobraz® and manufactured by Wall Colmonoy Corporation.

Addition of the containment compound 20 to the diffusion bar 18 and the surrounding area of the fuse 10 prevents the diffusion bar 18 from wetting the fusible link 12. Thus, more of the second conductive material, in the preferred embodiment tin, is available for the eutectic reaction with the first conductive material, in most cases copper, of the fusible link 12. The containment compound 20 can also provide a sufficiently high surface tension membrane around the diffusion bar 18 to provide vertical containment for the diffusion bar 18. Vertical containment is critical because at operation temperatures of the circuit, the diffusion bar 18 can ballistically project itself from the active area of the fuse 10 thus reducing the amount of the second conductive material available for the eutectic reaction.

The containment compound 20 can serve the additional purpose of isolating the diffusion bar 18, the fusible link 12, and the substrate 13 in the active area of the fuse 10 from the conformal layer 24. Thus, as overheating occurs, the fusible link 12, with a deficient amount of the second conductive material in the diffusion bar 18, reaches a temperature which quickly causes charring of the substrate 13. The hot fusible link 12 and the charred substrate 13 heat the conformal coating 24 to its flash point and ignite it. This could cause damage to the expensive circuit or provide other more serious hazards. With the containment compound 20 in place, the likelihood of overheating and charring is substantially reduced.

The conformal layer 24 forms a relatively tight seal over the upper portion 34 of the substrate 13, including the fusible link 12, the diffusion bar 18, and the containment compound 20. In this way, the conformal layer 24 inhibits corrosion of the exposed portions of the fuse 10 during its useful life. The conformal layer 24 also provides protection from oxidation and impacts during attachment to the printed circuit board. This conformal layer 24 also serves as a means of providing for a surface for pick and place operations which use a vacuum pick-up tool.

The conformal layer 24 helps to control the melting, ionization and arcing which occur in the fusible link 12 during current overload conditions. The conformal layer 24 or cover coat material provides desired arc-quenching characteristics, especially important upon interruption of the fusible link 12.

The conformal layer 24 may be comprised of a polymer, preferably a polycarbonate adhesive. One such polycarbonate adhesive is marketed under the trade name LOCTITE 3981. Other similar adhesives are suitable for the invention. In addition to polymers, the conformal layer 24 may also be comprised of plastics, other coatings and epoxies.

Although a colorless, clear polycarbonate adhesive is aesthetically pleasing, alternative types of adhesives may be used. For example, in producing the conformal layer 24 colored, clear adhesives may be used. These colored adhesives may be simply manufactured by the addition of a dye to a clear polycarbonate adhesive. Color coding may be accomplished through the use of these colored adhesives. In other words, different colors of adhesives can correspond to different amperages, providing the user with a ready means of determining the amperage of any given fuse. The transparency of both of these coatings permit the user to visually inspect the fusible link 12 prior to installation, and during use, in the electronic device in which the fuse 10 is used.

The use of this conformal layer 24 has significant advantages over the prior art, including the "capping" method. Due to the placement of the conformal layer 24 over the entire upper surface 34 of the fuse 10, the location of the conformal layer 24 relative to the location of the fusible link 12 is not critical.

In summary, the fuse of the present invention exhibits improved control of fusing characteristics by regulating voltage drops across the fusible link 12. Consistent clearing times are ensured by (1) the ability to control, through deposition and photolithography processes, the dimensions and shapes of the fusible link 12 and wide terminals pads 14, 16; and (2) proper selection of the materials of the fusible link 12. Restriking tendencies are minimized by selection of an optimized material for the substrate 13, the containment compound 20, and the protective layer 24.

While the specific embodiments have been illustrated and described, numerous modifications come to mind without significantly departing from the spirit of the invention, and the scope of protection is only limited by the scope of the accompanying Claims.

We claim:

1. A surface-mountable fuse for protection against electrical overload, said fuse comprising:

a fusible link of a first conductive material supported on a substrate and having a diffusion bar of a second conductive material along a section of the fusible link wherein under electrical overload conditions the fusible link will blow at or near the diffusion bar;

a containment compound deposited over a portion of the fusible link wherein under the electrical overload conditions the containment compound inhibits migration of the diffusion bar along the fusible link, wherein the containment compound covers a portion of the diffusion bar and extends onto the substrate adjacent to the fusible link; and, a pair of terminal pads formed on the substrate and electrically connected to the fusible link.

2. The surface-mountable fuse of claim 1 wherein each terminal pad further comprises a plurality of conductive layers.

3. The surface-mountable fuse of claim 2 wherein a first conductive layer and the fusible link form a single continuous film, and a second conductive layer is deposited on the first conductive layer.

4. The surface-mountable fuse of claim 3 wherein a third conductive layer is deposited on the second conductive layer.

5. The surface-mountable fuse of claim 4 wherein a fourth conductive layer is deposited on the third conductive layer.

6. The surface-mountable fuse of claim 1 wherein the first conductive material is of a copper.

7. The surface-mountable fuse of claim 1 wherein the second conductive material is of a tin.

8. The surface-mountable fuse of claim 1 wherein the containment compound covers a portion of the diffusion bar.

9. The surface-mountable fuse of claim 1 wherein the containment compound fully covers the diffusion bar.

10. The surface-mountable fuse of claim 1 wherein the containment compound extends onto the substrate by a distance of approximately 5 mils.

11. The surface-mountable fuse of claim 1 wherein the containment compound extends onto the substrate by a distance of approximately 10 mils.

12. The surface-mountable fuse of claim 1 wherein the containment compound comprises an alumina-silica clay.

13. The surface-mountable fuse of claim 12 wherein the alumina-silica clay is suspended in a solvent.

14. The surface-mountable fuse of claim 1 wherein the containment compound prevents a ballistic effect from occurring to the diffusion bar during the electrical overload condition.

15. The surface-mountable fuse of claim 1 wherein a conformal coating is placed over a portion of the surface-mount fuse.

16. The surface-mountable fuse of claim 15 wherein the conformal coating covers the diffusion bar and the containment compound.

17. The surface-mountable fuse of claim 16 wherein the containment compound is positioned between the diffusion bar and the conformal coating.

18. The surface-mountable fuse of claim 15 wherein the conformal coating is an epoxy-based coating.

19. The surface-mountable fuse of claim 15 wherein the conformal coating is a polymeric material.

20. The surface-mountable fuse of claim 15 wherein the conformal coating is a polycarbonate adhesive.

21. The surface-mountable fuse of claim 15 wherein the conformal coating is clear and colorless.

22. The surface-mountable fuse of claim 15 wherein the conformal coating is clear and colored.

23. The surface-mountable fuse of claim 1 wherein the substrate comprises FR-4 epoxy.

24. The surface-mountable fuse of claim 1 wherein the substrate comprises polyimide.

25. The surface-mountable fuse of claim 1 wherein a ratio of a thickness of the fusible link to a thickness of the diffusion bar is greater than 1.

26. The surface-mountable fuse of claim 1 wherein the ratio is between 1 and 2.5.

27. The surface-mountable fuse of claim 1 wherein the first conductive material is selected from the group including copper, silver, gold, zinc, tin, nickel, titanium, aluminum, or alloys thereof.

28. A surface-mountable fuse for protection against electrical overload, said fuse comprising:

an electrically insulating substrate;

a pair of terminal pads deposited on the substrate;

a fusible link composed of a first conductive material deposited on the substrate and electrically connecting the terminal pads;

a diffusion bar composed of a second conductive material deposited on the fusible link;

a containment compound disposed on the diffusion bar, wherein the containment compound is an alumina-silica clay, and wherein the containment compound inhibiting migration of the diffusion bar along the fusible link under electrical overload conditions; and a protective layer deposited over the fusible link.

29. A thin film surface-mountable fuse for protection against electrical overload, said fuse comprising:

a fusible link of a first conductive material deposited on a substrate and having a diffusion bar of a second conductive material along a section of the fusible link wherein under an electrical overstress situation the fusible link will blow at or near the diffusion bar;

a containment compound deposited over a portion of the fusible link wherein the containment compound extends onto the substrate, and wherein under the electrical overstress situation, the containment compound inhibits migration of the diffusion bar along the fusible link;

a pair of terminal pads electrically connected to the fusible link each terminal pad having a first conductive layer integral with the fusible link to form a continuous layer, a second conductive layer deposited on the first conductive layer, a third conductive layer deposited on the second conductive layer, a fourth conductive layer deposited on the third conductive layer; and a conformal layer deposited over a portion of the fuse to provide protection against external forces.

* * * * *